US007305198B2

(12) United States Patent
Julien

(10) Patent No.: US 7,305,198 B2
(45) Date of Patent: Dec. 4, 2007

(54) PRINTING SYSTEM

(75) Inventor: Paul C. Julien, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 394 days.

(21) Appl. No.: 11/095,872

(22) Filed: Mar. 31, 2005

(65) Prior Publication Data

US 2006/0221362 A1 Oct. 5, 2006

(51) Int. Cl.
*G03G 15/20* (2006.01)

(52) U.S. Cl. ..... 399/69; 399/335; 399/337; 399/400

(58) Field of Classification Search ..... 399/67–69, 399/15, 335, 337, 400
See application file for complete search history.

(56) References Cited

U.S. PATENT DOCUMENTS

| | | | |
|---|---|---|---|
| 4,579,446 | A | 4/1986 | Fujino et al. |
| 4,579,466 | A | 4/1986 | Sato |
| 4,586,812 | A | 5/1986 | Kaneko et al. |
| 4,587,532 | A | 5/1986 | Asano |
| 4,591,884 | A | 5/1986 | Miyamoto et al. |
| 4,836,119 | A | 6/1989 | Siraco |
| 4,972,236 | A | 11/1990 | Hasegawa |
| 5,004,222 | A | 4/1991 | Dobashi |
| 5,008,713 | A | 4/1991 | Ozawa et al. |
| 5,080,340 | A | 1/1992 | Hacknauer |
| 5,095,342 | A | 3/1992 | Farrell |
| 5,150,167 | A | 9/1992 | Gonda et al. |
| 5,155,558 | A | 10/1992 | Tannenbaum et al. |
| 5,159,395 | A | 10/1992 | Farrell |
| 5,208,640 | A | 5/1993 | Horie |
| 5,272,511 | A | 12/1993 | Conrad |
| 5,280,368 | A | 1/1994 | Fullerton |
| 5,287,162 | A | 2/1994 | de Jong et al. |
| 5,326,093 | A | 7/1994 | Sollitt |
| 5,389,969 | A | 2/1995 | Suzuki |
| 5,435,544 | A | 7/1995 | Mandel |

(Continued)

FOREIGN PATENT DOCUMENTS

| | | | |
|---|---|---|---|
| JP | 05333643 | A | 12/1993 |

(Continued)

OTHER PUBLICATIONS

Morgan, P.F., "Integration of Black Only and Color Printers", Xerox Disclosure Journal, vol. 16, No. 6, Nov./Dec. 1991, pp. 381-383.

(Continued)

*Primary Examiner*—David M. Gray
*Assistant Examiner*—Geoffrey T Evans
(74) *Attorney, Agent, or Firm*—Eugene O. Palazzo; Fay Sharpe LLP

(57) ABSTRACT

A printing system includes a plurality of marking engines for applying images to print media. An output destination is configured for receiving imaged print media from the plurality of marking engines. A print media transport system conveys print media between the marking engines and the output destination. A control system determines whether the marking engines are printing images of consistent or acceptable gloss and, where the marking engines are determined not to be consistent or providing acceptable gloss, adjusts at least one of the plurality of marking engines to reduce a variation in gloss between images applied by the marking engines.

19 Claims, 5 Drawing Sheets

U.S. PATENT DOCUMENTS 5,443,254 A 8/1995 Reist
5,467,710 A 11/1995 Wirz
5,473,419 A 12/1995 Russel
5,479,856 A 1/1996 Wirz
5,489,969 A 2/1996 Soler et al.
5,497,218 A 3/1996 Amico
5,504,568 A 4/1996 Saraswat
5,525,031 A 6/1996 Fox
5,557,367 A 9/1996 Yang
5,568,246 A 10/1996 Keller
5,570,172 A 10/1996 Acquaviva
5,574,527 A 11/1996 Folkins
5,596,416 A 1/1997 Barry
5,598,257 A 1/1997 Keller et al.
5,629,762 A 5/1997 Mahoney
5,655,208 A 8/1997 Sahay et al.
5,710,968 A 1/1998 Clark
5,730,535 A 3/1998 Keller et al.
5,748,221 A 5/1998 Castelli et al.
5,752,776 A 5/1998 Kunreuther
5,778,377 A 7/1998 Marlin
5,839,016 A 11/1998 Folkins et al.
5,859,711 A 1/1999 Barry et al.
5,884,910 A 3/1999 Mandel
5,940,186 A 8/1999 Barry et al.
5,963,770 A 10/1999 Eakin
5,995,721 A 11/1999 Rourke
6,005,687 A 12/1999 Kawashima et al.
6,035,103 A 3/2000 Zuber
6,059,284 A 5/2000 Wolf
6,097,500 A 8/2000 Fromherz
6,101,345 A * 8/2000 Van Goethem et al. ..... 399/69
6,125,248 A 9/2000 Moser
6,212,357 B1 4/2001 Boehmer et al.
6,241,242 B1 6/2001 Munro
6,269,237 B1 7/2001 Olbrich et al.
6,297,886 B1 10/2001 Cornell
6,337,958 B1 1/2002 Stanich et al.
6,341,773 B1 1/2002 Aprato et al.
6,344,902 B1 2/2002 Duke et al.
6,384,918 B1 5/2002 Hubble, III
6,438,336 B1 8/2002 Bengtson
6,450,711 B1 9/2002 Conrow
6,456,310 B1 9/2002 Wallace et al.
6,476,376 B1 11/2002 Biegelsen
6,476,923 B1 11/2002 Cornell
6,493,098 B1 12/2002 Cornell
6,501,929 B1 12/2002 Warbus et al.
6,537,910 B1 3/2003 Burke
6,550,762 B2 4/2003 Stoll
6,554,276 B2 4/2003 Jackson
6,567,621 B2 5/2003 Miyoshi et al.
6,577,925 B1 6/2003 Fromherz
6,606,165 B1 8/2003 Barry et al.
6,607,320 B2 8/2003 Bobrow
6,608,988 B2 8/2003 Conrow
6,612,566 B2 9/2003 Stoll
6,612,571 B2 9/2003 Rider
6,618,167 B1 9/2003 Shah
6,621,576 B2 9/2003 Tandon
6,633,382 B2 10/2003 Hubble, III
6,639,669 B2 10/2003 Hubble, III
6,654,136 B2 11/2003 Shimada
6,675,957 B2 1/2004 Greive et al.
6,697,582 B1 2/2004 Scheuer
6,714,834 B1 3/2004 Roth et al.
6,760,553 B2 7/2004 Mitsuya et al.
6,819,906 B1 11/2004 Herrmann
6,925,283 B1 8/2005 Mandel et al.
6,950,615 B2 9/2005 Jung et al.
6,959,165 B2 10/2005 Mandel et al.
6,973,286 B2 12/2005 Mandel et al.
7,024,152 B2 4/2006 Lofthus et al.
7,046,364 B2 5/2006 Schneider et al.
7,123,873 B2 10/2006 deJong et al.
2001/0021027 A1 9/2001 Ueno et al.
2002/0015177 A1 2/2002 Yamakado et al.
2002/0078012 A1 6/2002 Ryan
2002/0103559 A1 8/2002 Gartstein
2003/0007154 A1 1/2003 Tandon et al.
2003/0049039 A1 3/2003 Suzuki
2003/0063275 A1 4/2003 Hubble, III et al.
2003/0077095 A1 4/2003 Conrow
2003/0095722 A1 5/2003 Regimbal
2003/0128993 A1 7/2003 Mitsuya et al.
2003/0133731 A1 7/2003 Nakazawa et al.
2004/0057741 A1 3/2004 Uehara et al.
2004/0085561 A1 5/2004 Fromherz
2004/0085562 A1 5/2004 Fromherz
2004/0088207 A1 5/2004 Fromherz
2004/0150156 A1 8/2004 Fromherz
2004/0150158 A1 8/2004 Biegelsen
2004/0153983 A1 8/2004 McMillan
2004/0216002 A1 10/2004 Fromherz
2004/0225391 A1 11/2004 Fromherz
2004/0225394 A1 11/2004 Fromherz
2004/0247365 A1 12/2004 Lofthus et al.
2004/0257596 A1 12/2004 Mestha et al.
2006/0033771 A1 2/2006 Lofthus et al.
2006/0034631 A1 2/2006 Lofthus et al.
2006/0067756 A1 3/2006 Anderson et al.
2006/0067757 A1 3/2006 Anderson et al.
2006/0114313 A1 6/2006 Moore
2006/0114497 A1 6/2006 Anderson et al.
2006/0115284 A1 6/2006 Grace et al.
2006/0115287 A1 6/2006 Roof
2006/0115288 A1 6/2006 Roof
2006/0132815 A1 6/2006 Lofthus et al.
2006/0176336 A1 8/2006 Moore et al.
2006/0197966 A1 9/2006 Viturro et al.
2006/0209101 A1 9/2006 Mizes
2006/0214359 A1 9/2006 Clark
2006/0214364 A1 9/2006 Clark et al.
2006/0215240 A1 9/2006 Mongeon
2006/0221159 A1 10/2006 Moore et al.
2006/0221362 A1 10/2006 Julien et al.
2006/0222384 A1 10/2006 Moore et al.
2006/0222393 A1 10/2006 de Jong et al.
2006/0230201 A1 10/2006 Fromherz et al.

FOREIGN PATENT DOCUMENTS

JP 2003140415 A 5/2003
JP 2003156969 A 5/2003
JP 2004226484 A 8/2004
JP 2004226826 A 8/2004

OTHER PUBLICATIONS

Desmond Fretz, "Cluster Printing Solution Announced", Today at Xerox (TAX), No. 1129, Aug. 3, 2001.
U.S. Appl. No. 10/761,522, filed Jan. 21, 2004, Mandel et al.
U.S. Appl. No. 10/785,211, filed Feb. 24, 2004, Lofthus et al.
U.S. Appl. No. 10/860,195, filed Aug, 23, 2004, Lofthus et al.
U.S. Appl. No. 10/881,619, filed Jun. 30, 2004, Bobrow.
U.S. Appl. No. 10/917,676, filed Aug. 13, 2004, Lofthus et al.
U.S. Appl. No. 10/917,768, filed Aug. 13, 2004, Lofthus et al.
U.S. Appl. No. 10/924,106, filed Aug. 23, 2004, Lofthus et al.
U.S. Appl. No. 10/924,113, filed Aug. 23, 2004, deJong et al.
U.S. Appl. No. 10/924,458, filed Aug. 23, 2004, Lofthus et al.
U.S. Appl. No. 10/924,459, filed Aug. 23, 2004, Mandel et al.
U.S. Appl. No. 10/933,556, filed Sep. 3, 2004, Spencer et al.
U.S. Appl. No. 10/953,953, filed Sep. 29, 2004, Radulski et al.
U.S. Appl. No. 10/999,326, filed Nov. 30, 2004, Grace et al.
U.S. Appl. No. 10/999,450, filed Nov. 30, 2004, Lofthus et al.

U.S. Appl. No. 11/000,158, filed Nov. 30, 2004, Roof
U.S. Appl. No. 11/000,168, filed Nov. 30, 2004, Biegelsen et al.
U.S. Appl. No. 11/000,258, filed Nov. 30, 2004, Roof.
U.S. Appl. No. 11/001,890, filed Dec. 2, 2004, Lofthus et al.
U.S. Appl. No. 11/002,528, filed Dec. 2, 2004, Lofthus et al.
U.S. Appl. No. 11/051,817, filed Feb. 4, 2005, Moore et al.
U.S. Appl. No. 11/070,681, filed Mar. 2, 2005, Viturro et al.
U.S. Appl. No. 11/081,473, filed Mar. 16, 2005, Moore
U.S. Appl. No. 11/069,020, filed Feb. 28, 2005, Lofthus et al.
U.S. Appl. No. 11/089,854, filed Mar. 25, 2005, Clark et al.
U.S. Appl. No. 11/090,498, filed Mar. 25, 2005, Clark.
U.S. Appl. No. 11/090,502, filed Mar. 25, 2005, Mongeon.
U.S. Appl. No. 11/095,378, filed Mar. 31, 2005, Moore et al.
U.S. Appl. No. 11/094,998, filed Mar. 31, 2005, Moore et al.
U.S. Appl. No. 11/094,864, filed Mar. 31, 2005, de Jong et al.
U.S. Appl. No. 11/095,872, filed Mar. 31, 2005, Julien et al.
U.S. Appl. No. 11/102,355, filed Apr. 8, 2005, Fromherz et al.
U.S. Appl. No. 11/084,280, filed Mar. 18, 2005, Mizes.
U.S. Appl. No. 11/109,566, filed Apr. 19, 2005, Mandel et al.
U.S. Appl. No. 11/109,558, filed Apr. 19, 2005, Furst et al.
U.S. Appl. No. 11/109,996, filed Apr. 20, 2005, Mongeon et al.
U.S. Appl. No. 11/093,229, filed Mar. 29, 2005, Julien.
U.S. Appl. No. 11/102,899, filed Apr. 8, 2005, Crawford et al.
U.S. Appl. No. 11/102,910, filed Apr. 8, 2005, Crawford et al.
U.S. Appl. No. 11/115,766, filed Apr. 27, 2005, Grace.
U.S. Appl. No. 11/102,332, filed Apr. 8, 2005, Hindi et al.
U.S. Appl. No. 11/136,959, filed May 25, 2005, German et al.
U.S. Appl. No. 11/122,420, filed May 5, 2005, Richards.
U.S. Appl. No. 11/137,634, filed May 25, 2005, Lofthus et al.
U.S. Appl. No. 11/137,251, filed May 25, 2005, Lofthus et al.
U.S. Appl. No. 11/137,273, filed May 25, 2005, Anderson et al.
U.S. Appl. No. 11/152,275, filed Jun. 14, 2005, Roof et al.
U.S. Appl. No. 11/156,778, filed Jun. 20, 2005, Swift.
U.S. Appl. No. 11/157,598, filed Jun. 21, 2005, Frankel.
U.S. Appl. No. 11/143,818, filed Jun. 2, 2005, Dalal et al.
U.S. Appl. No. 11/146,665, filed Jun. 7, 2005, Mongeon.
U.S. Appl. No. 11/166,299, filed Jun. 24, 2005, Moore.
U.S. Appl. No. 11/166,460, filed Jun. 24, 2005, Roof et al.
U.S. Appl. No. 11/166,581, filed Jun. 24, 2005, Lang et al.
U.S. Appl. No. 11/170,873, filed Jun. 30, 2005, Klassen.
U.S. Appl. No. 11/170,975, filed Jun. 30, 2005, Klassen.
U.S. Appl. No. 11/170,845, filed Jun. 30, 2005, Sampath et al.
U.S. Appl. No. 11/189,371, filed Jul. 26, 2005, Moore et al.
U.S. Appl. No. 11/212,367, filed Aug. 26, 2005, Anderson et al.
U.S. Appl. No. 11/208,871, filed Aug. 22, 2005, Dalal et al.
U.S. Appl. No. 11/215,791, filed Aug. 30, 2005, Hamby et al.
U.S. Appl. No. 11/234,468, filed Sep. 23, 2005, Hamby et al.
U.S. Appl. No. 11/234,553, filed Sep. 23, 2005, Mongeon.
U.S. Appl. No. 11/222,260, filed Sep. 8, 2005, Goodman et al.
U.S. Appl. No. 11/235,979, filed Sep. 27, 2005, Anderson et al.
U.S. Appl. No. 11/247,778, filed Oct. 11, 2005, Radulski et al.
U.S. Appl. No. 11/248,044, filed Oct. 12, 2005, Spencer et al.
U.S. Appl. No. 11/236,099, filed Sep. 27, 2005, Anderson et al.

* cited by examiner

PRINTING SYSTEM

CROSS REFERENCE TO RELATED PATENTS AND APPLICATIONS

The following applications, the disclosures of each being totally incorporated herein by reference are mentioned:

U.S. Provisional Application Ser. No. 60/631,651, filed Nov. 30, 2004, entitled "TIGHTLY INTEGRATED PARALLEL PRINTING ARCHITECTURE MAKING USE OF COMBINED COLOR AND MONOCHROME ENGINES," by David G. Anderson, et al.;

U.S. Provisional Patent Application Ser. No. 60/631,918, filed Nov. 30, 2004, entitled "PRINTING SYSTEM WITH MULTIPLE OPERATIONS FOR FINAL APPEARANCE AND PERMANENCE," by David G. Anderson et al.;

U.S. Provisional Patent Application Ser. No. 60/631,921, filed Nov. 30, 2004, entitled "PRINTING SYSTEM WITH MULTIPLE OPERATIONS FOR FINAL APPEARANCE AND PERMANENCE," by David G. Anderson et al.;

U.S. application Ser. No. 10/761,522, filed Jan. 21, 2004, entitled "HIGH RATE PRINT MERGING AND FINISHING SYSTEM FOR PARALLEL PRINTING," by Barry P. Mandel, et al.;

U.S. application Ser. No. 10/785,211, filed Feb. 24, 2004, entitled "UNIVERSAL FLEXIBLE PLURAL PRINTER TO PLURAL FINISHER SHEET INTEGRATION SYSTEM," by Robert M. Lofthus, et al.;

U.S. application Ser. No. 10/860,195, filed Aug. 23, 2004, entitled "UNIVERSAL FLEXIBLE PLURAL PRINTER TO PLURAL FINISHER SHEET INTEGRATION SYSTEM," by Robert M. Lofthus, et al.;

U.S. application Ser. No. 10/881,619, filed Jun. 30, 2004, entitled "FLEXIBLE PAPER PATH USING MULTIDIRECTIONAL PATH MODULES," by Daniel G. Bobrow.;

U.S. application Ser. No. 10/917,676, filed Aug. 13, 2004, entitled "MULTIPLE OBJECT SOURCES CONTROLLED AND/OR SELECTED BASED ON A COMMON SENSOR," by Robert M. Lofthus, et al.;

U.S. application Ser. No. 10/917,768, filed Aug. 13, 2004, entitled "PARALLEL PRINTING ARCHITECTURE CONSISTING OF CONTAINERIZED IMAGE MARKING ENGINES AND MEDIA FEEDER MODULES," by Robert M. Lofthus, et al.;

U.S. application Ser. No. 10/924,106, filed Aug. 23, 2004, entitled "PRINTING SYSTEM WITH HORIZONTAL HIGHWAY AND SINGLE PASS DUPLEX," by Lofthus, et al.;

U.S. application Ser. No. 10/924,113, filed Aug. 23, 2004, entitled "PRINTING SYSTEM WITH INVERTER DISPOSED FOR MEDIA VELOCITY BUFFERING AND REGISTRATION," by Joannes N. M. dejong, et al.;

U.S. application Ser. No. 10/924,458, filed Aug. 23, 2004, entitled "PRINT SEQUENCE SCHEDULING FOR RELIABILITY," by Robert M. Lofthus, et al.;

U.S. patent application Ser. No. 10/924,459, filed Aug. 23, 2004, entitled "PARALLEL PRINTING ARCHITECTURE USING IMAGE MARKING DEVICE MODULES," by Barry P. Mandel, et al;

U.S. patent application Ser. No. 10/933,556, filed Sep. 3, 2004, entitled "SUBSTRATE INVERTER SYSTEMS AND METHODS," by Stan A. Spencer, et al.;

U.S. patent application Ser. No. 10/953,953, filed Sep. 29, 2004, entitled "CUSTOMIZED SET POINT CONTROL FOR OUTPUT STABILITY IN A TIPP ARCHITECTURE," by Charles A. Radulski et al.;

U.S. application Ser. No. 10/999,326, filed Nov. 30, 2004, entitled "SEMI-AUTOMATIC IMAGE QUALITY ADJUSTMENT FOR MULTIPLE MARKING ENGINE SYSTEMS," by Robert E. Grace, et al.;

U.S. patent application Ser. No. 10/999,450, filed Nov. 30, 2004, entitled "ADDRESSABLE FUSING FOR AN INTEGRATED PRINTING SYSTEM," by Robert M. Lofthus, et al.;

U.S. patent application Ser. No. 11/000,158, filed Nov. 30, 2004, entitled "GLOSSING SYSTEM FOR USE IN A TIPP ARCHITECTURE," by Bryan J. Roof;

U.S. patent application Ser. No. 11/000,168, filed Nov. 30, 2004, entitled "ADDRESSABLE FUSING AND HEATING METHODS AND APPARATUS," by David K. Biegelsen, et al.;

U.S. patent application Ser. No. 11/000,258, filed Nov. 30, 2004, entitled "GLOSSING SYSTEM FOR USE IN A TIPP ARCHITECTURE," by Bryan J. Roof;

U.S. application Ser. No. 11/001,890, filed Dec. 2, 2004, entitled "HIGH RATE PRINT MERGING AND FINISHING SYSTEM FOR PARALLEL PRINTING," by Robert M. Lofthus, et al.;

U.S. application Ser. No. 11/002,528, filed Dec. 2, 2004, entitled "HIGH RATE PRINT MERGING AND FINISHING SYSTEM FOR PARALLEL PRINTING," by Robert M. Lofthus, et al.;

U.S. application Ser. No. 11/051,817, filed Feb. 4, 2005, entitled "PRINTING SYSTEMS," by Steven R. Moore, et al.;

U.S. application Ser. No. 11/069,020, filed Feb. 28, 2004, entitled "PRINTING SYSTEMS," by Robert M. Lofthus, et al.;

U.S. application Ser. No. 11/070,681, filed Mar. 2, 2005, entitled "GRAY BALANCE FOR A PRINTING SYSTEM OF MULTIPLE MARKING ENGINES," by R. Enrique Viturro, et al.;

U.S. application Ser. No. 11/081,473, filed Mar. 16, 2005, entitled "MULTI-PURPOSE MEDIA TRANSPORT HAVING INTEGRAL IMAGE QUALITY SENSING CAPABILITY," by Steven R. Moore;

U.S. application Ser. No. 11/084,280, filed Mar. 18, 2005, entitled "SYSTEMS AND METHODS FOR MEASURING UNIFORMITY IN IMAGES," by Howard Mizes;

U.S. application Ser. No. 11/089,854, filed Mar. 25, 2005, entitled "SHEET REGISTRATION WITHIN A MEDIA INVERTER," by Robert A. Clark et al.;

U.S. application Ser. No. 11/090,498, filed Mar. 25, 2005, entitled "INVERTER WITH RETURN/BYPASS PAPER PATH," by Robert A. Clark;

U.S. application Ser. No. 11/090,502, filed Mar. 25, 2005, entitled IMAGE QUALITY CONTROL METHOD AND APPARATUS FOR MULTIPLE MARKING ENGINE SYSTEMS," by Michael C. Mongeon; and U.S. application Ser. No. 11/093,229, filed Mar. 29, 2005, entitled "PRINTING SYSTEM," by Paul C. Julien.

BACKGROUND

The present exemplary embodiment relates to generally to fusing of images in a printing system including a plurality of marking engines. It finds particular application in conjunction with a printing system in which images generated by two or more marking engines are destined to be assembled into the same document. However, it is to be appreciated that the present exemplary embodiment is also amenable to other like applications.

In a typical xerographic marking engine, such as a copier or printer, a photoconductive insulating member is charged to a uniform potential and thereafter exposed to a light image of an original document to be reproduced. The exposure discharges the photoconductive insulating surface in exposed or background areas and creates an electrostatic latent image on the member, which corresponds to the image areas contained within the document. Subsequently, the electrostatic latent image on the photoconductive insulating surface is made visible by developing the image with a developing material. Generally, the developing material comprises toner particles adhering triboelectrically to carrier granules. The developed image is subsequently transferred to a print medium, such as a sheet of paper. The fusing of the toner onto the paper is generally accomplished by applying heat to the toner with a heated roller and application of pressure. The fusing operation serves both to fix the image to the paper and also to impart gloss. In general, higher fuser roll temperatures pressures and longer dwell times are associated with higher gloss levels. For color printing, high gloss levels are often desired and thus fusers are generally run at well above the minimum temperature for achieving adequate fix.

Systems which incorporate several small marking engines have recently been developed. These systems enable high overall outputs to be achieved by printing portions of the same document on multiple marking engines. Such systems are commonly referred to as "tandem engine" printers, "parallel" printers, or "cluster printing" systems (in which an electronic print job may be split up for distributed higher productivity printing by different marking engines, such as separate printing of the color and monochrome pages). Such integrated printing systems have multiple fusers since each marking engine incorporates the fuser or fusers appropriate for fusing the images applied by that particular marking engine.

In some multiple marking engine systems, a process known as "tandem duplex printing" is employed. In this process, a first marking engine applies an image to a first side of a sheet and a second marking engine applies an image to a second side of the sheet. Each of the marking engines is thus operating in a simplex mode to generate a duplex print. As a result, a finished document, when assembled, may include images generated by two or more marking engines. The eye is particularly sensitive to any variations in gloss between images when these are in a side-by-side relationship.

Although nominally equivalent, marking engines may provide different levels of gloss. Indeed the gloss level of a marking engine may vary over the course of a day, depending on the use of the marking engine.

REFERENCES

The following references, the disclosures of which are incorporated herein by reference in their entireties, variously relate to "tandem engine" printers, "parallel" printers, "cluster printing", and "output merger" or "interposer" systems: U.S. Pat. No. 5,568,246 to Keller, et al., U.S. Pat. No. 4,587,532 to Asano, U.S. Pat. No. 5,570,172 to Acquaviva, U.S. Pat. No. 5,596,416 to Barry, et al.; U.S. Pat. No. 5,995,721 to Rourke et al; U.S. Pat. No. 4,579,446 to Fujino; U.S. Pat. No. 5,389,969 to to Soler, et al.; a 1991 "Xerox Disclosure Journal" publication of Nov.-Dec. 1991, Vol. 16, No. 6, pp. 381-383 by Paul F. Morgan; and a Xerox Aug. 3, 2001 "TAX" publication product announcement entitled "Cluster Printing Solution Announced."

BRIEF DESCRIPTION

Aspects of the present disclosure in embodiments thereof include a printing system, a method, and a system of printing. In one aspect, the printing system includes a plurality of marking engines which are operatively coupled for applying images to print media. An output destination is configured for receiving imaged print media from the plurality of marking engines. A print media transport system conveys print media between the marking engines and the output destination and a control system determines whether the marking engines are printing images of acceptable gloss and optionally adjusts at least one of the plurality of marking engines to minimize a variation in gloss of the images, such as a variation in the gloss of images generated by a first of the marking engines from the gloss of images generated by a second of the marking engines.

In another aspect, the printing system includes first and second marking engines of the same print modality which are operatively connected to each other for applying images to print media. The applied images form part of a print job which, when assembled, includes an image applied by the first marking engine which is positioned adjacent an image applied by the second marking engine. A first fuser is associated with the first marking engine and a second fuser is associated with the second marking engine. A sensor measures gloss of media printed by the first and second marking engines. Each of the marking engines includes an adjustment mechanism whereby the fuser temperature of at least one of the marking engines is adjustable to reduce a variation in gloss between the marking engines.

In one aspect, the method of printing includes determining whether a plurality of marking engines which are operatively coupled are printing images of consistent gloss and, where the marking engines are determined not to be consistent, adjusting at least one of the plurality of marking engines to reduce a variation in gloss between images applied by the marking engines. The method further includes printing images on print media with the plurality of marking engines and conveying the printed images in a common stream to an output destination.

DETAILED DESCRIPTION

Figure 1:
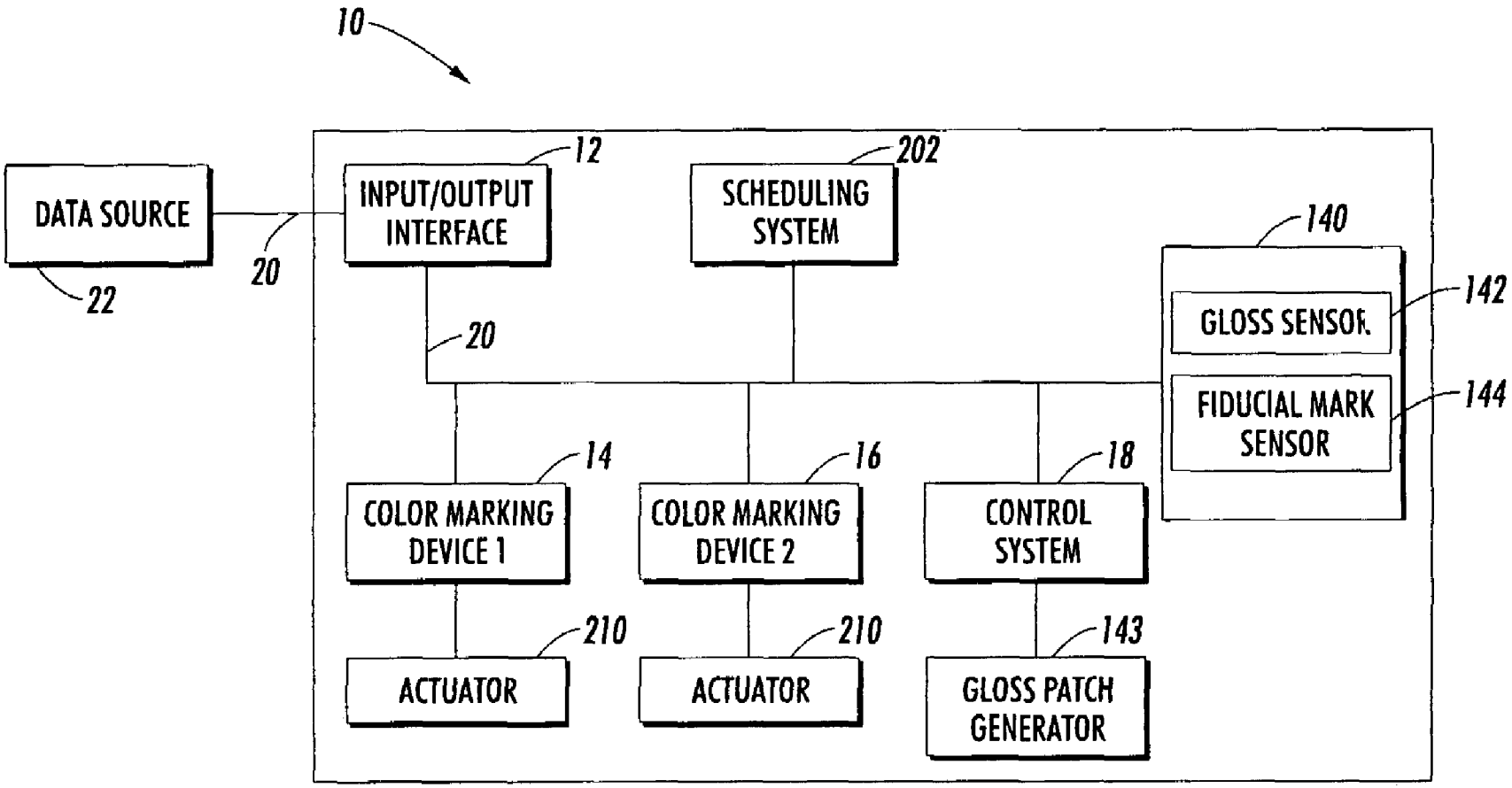
FIG. 1 is a schematic view of a printing system according to an exemplary embodiment.

Aspects of the present disclosure in embodiments thereof relate to a printing system including multiple marking engines in which print media outputs of the marking engines are directed to a common output destination for assembly into a finished document. The marking engines may be operatively coupled for printing images from a common job stream, such as a set of images in digital form. For example, the marking engines are under the control of a common control system which, in one mode of operation, controls the marking engines printing a job to ensure that the print media outputs of the marking engines are consistent, for example, have consistent gloss levels in the images applied by the marking engines. In one embodiment, the control system includes a driver which directs one or more of the marking engines to adjust a fuser roll temperature to bring the marking engines within a predefined gloss variation. The control system may adjust the marking engine or engines such that the gloss levels match those of the marking engine having the lowest maximum achievable gloss level. The gloss level of the images may be determined by a sensor, either automatically, such with as an in-line sensor with an automated feedback loop, or manually, such as with an off-line sensor.

The term "marking engine" is used herein to refer to a device for applying an image to print media. "Print media" can be a usually flimsy physical sheet of paper, plastic, or other suitable physical print media substrate for images, whether precut or web fed. The printing system may include a variety of other components, such as finishers, paper feeders, and the like, and may be embodied as a copier, printer, or a multifunction machine. A "print job" or "document" is normally a set of related sheets, usually one or more collated copy sets copied from a set of original print job sheets or electronic document page images, from a particular user, or otherwise related. An "output destination" can be any post printing destination where the printed pages of a document are together, ordered in a sequence in which they can be assembled into in the finished document, such as a finisher or a temporary holding location. A "finisher" can be any post-printing accessory device such as an inverter, reverter, sorter, mailbox, inserter, interposer, folder, stapler, collater, stitcher, binder, over-printer, envelope stuffer, postage machine, output tray, or the like. A finisher may include several finishing stations. In general, a finishing station can only process one document at a time.

Consistent gloss levels can be considered to be those which are viewed as being the same by the average observer under normal lighting conditions.

A fuser of a marking engine serves two purposes: to affix the toner to the print media, which is referred to as "fix," and to provide a desired level of gloss. For a given set of operating conditions, such as fuser roll pressure and dwell time, a fuser can generally operate over a range of temperatures, the lower end of the range being determined by the desire to achieve a minimum acceptable level of fix, and the upper end of the range being determined by the operating capability of the fuser.

The lower end of the fuser temperature range can be determined by crease area measurements. For example, media is printed and a fold or "crease" formed. The toner loosened during creasing is brushed off the print media and the white area, corresponding to the detached toner, is measured. The crease area value can be normalized to give a crease index. Higher crease indexes are associated with lower levels of fix and vice versa. An acceptable maximum crease index can be defined based on user preferences. The minimum temperature of the fuser can then be determined as being that which provides the maximum acceptable crease index.

The gloss level continuously rises and the crease area (a measure of fix) continuously falls as the fusing temperature is raised. Once a selected crease area has been attained, the toner is adequately fixed and further raising the fuser temperature has no particular benefit to fix. However, higher gloss generally gives higher chroma (more vivid color), and fusers are generally run well above the minimum temperature necessary to achieve adequate fix in order to raise the gloss level.

The upper end of the fuser temperature operating range is generally dictated by the marking engine and/or toner used. The "hot offset" temperature is defined as the fuser temperature at which the toner becomes so liquid that it adheres to the heated fuser roll, rather than to the print media. Different toners may have different hot offset temperatures. Thus, the hot offset temperature for a fuser depends, to some degree, on the toner being applied in the marking engine. The upper end of the fuser operating temperature range is at or lower than the hot offset temperature. Additionally, a fuser of a marking engine typically has maximum operating temperature at which the fuser can run without appreciable damage to marking engine components, such as baffles, etc. A preset maximum operating temperature is thus generally no higher than the hot offset temperature and the maximum operating temperature and is associated with a maximum achievable gloss for the particular marking engine. The fuser thus has a workable operating range between the lower and upper limits, determined as described above. Although nominally identical in construction, different marking engines may have different minimum and maximum temperatures.

In an operating mode where attention is not paid to consistency of outputs between marking engines, when a user specifies high gloss, a fuser is typically set to the preset maximum operating temperature. Thus, in a system of multiple marking engines, each marking engine is operating at its preset maximum, which may vary from marking engine to marking engine. As a result, gloss levels of images from different marking engines may vary. Additionally, even where marking engines are nominally operating at the same temperature and thus expected to achieve the same high gloss, differences in gloss levels of images from different marking engines can occur due to minor variations in dwell times, pressures, surface non-uniformities, conformability of the fuser roll material, nip temperatures, and the like. As a result, variations in gloss levels of images from different marking engines can occur.

Aspects of the present embodiment disclosed herein provide a greater consistency between the outputs of different marking engines contributing to the same document. In one embodiment, a greater priority is placed on achievement of consistency of image gloss between marking engines than on achievement of the highest possible gloss, which may be inconsistent between marking engines. As a result, when a document is assembled from images produced by two or more marking engines, it is much less apparent to the eye of an observer that the images are derived from different marking engines and, for practical purposes, the gloss levels of the images can be indistinguishable from one another.

The printing system may incorporate "tandem engine" printers, "parallel" printers, "cluster printing," "output merger," or "interposer" systems, and the like, as disclosed, for example, in U.S. Pat. Nos. 4,579,446; 4,587,532; 5,489,969 5,568,246; 5,570,172; 5,596,416; 5,995,721; 6,554,276, 6,654,136; 6,607,320, and in above-mentioned application Ser. Nos. 10/924,459 and 10/917,768, the disclosures of which are totally incorporated herein by reference. A parallel printing system feeds paper from a common paper stream to a plurality of marking engines, which may be horizontally and/or vertically stacked. Printed media from the various marking engines is then taken from the marking engine to a finisher where the sheets associated with a single print job are assembled. Variable vertical level, rather than horizontal, input and output sheet path interface connections may be employed, as disclosed, for example, in U.S. Pat. No. 5,326,093 to Sollitt.

With reference to FIG. 1, an exemplary printing system 10 is shown. The printing system includes an input output interface 12, a plurality of marking engines 14, 16, and a common control system 18, all interconnected by links 20. The links can be wired or wireless links or other means capable of supplying electronic data to and/or from the connected elements. Exemplary links include telephone lines, computer cables, ISDN lines, and the like. A data source 22, such as a personal computer, network server or scanner, serves as an image input device. The network server, may, in turn, be linked to one or more workstations, such as personal computers (not shown). The input output interface 12 may include conversion electronics for converting the image-bearing documents to image signals or pixels, or this function may be assumed by the marking engines.

While FIG. 1 shows two color marking engines 14, 16, by way of example, it will be appreciated that the printing system may include more than two marking engines, such as three, four, six, or eight marking engines. The marking engines may be electrophotographic printers, ink-jet printers, including solid ink printers, and other devices capable of marking an image on a substrate. The marking engines can be of the same print modality (e.g., process color (P), custom color (C), black (K), or magnetic ink character recognition (MICR)) or of different print modalities. The marking engines all communicate with the control system 18.

Figure 2:
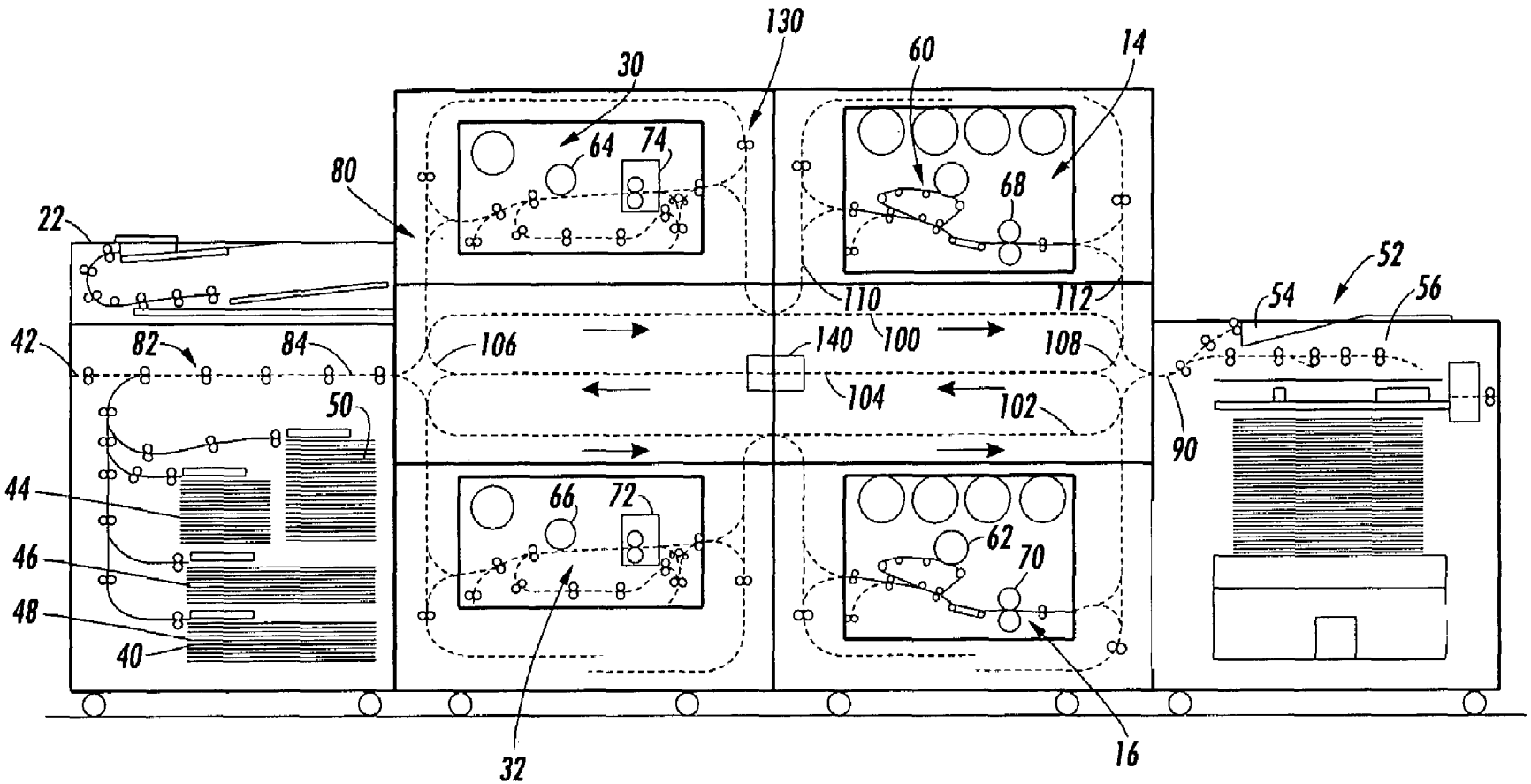
FIG. 2 is a side sectional view of the printing system of FIG. 1.

With reference now to FIG. 2, which shows the architecture of an exemplary printing system of the type illustrated in FIG. 1, the printing system 10 includes two color (P) marking engines 14, 16 and may also include two additional marking engines 30, 32, which may be of the same print modality or a different print modality, such as black (K) marking engines. Marking engines 30, 32 are also under the control of the common control system 18. The marking engines are all fed with print media 40 from a print media source 42, such as a high speed paper feeder, herein illustrated as including a plurality of paper trays 44, 46, 48, 50. Alternatively, the marking engines can be fed with print media from separate sources. Printed media from the marking engines is delivered to a common output destination, such as a finisher 52, herein illustrated as including a plurality of output trays 54, 56. The marking engines 14, 16, 30, 32 each include an imaging component 60, 62, 64, 66 and an associated fuser 68, 70, 72, 74, respectively. The imaging component applies toner to the print media to form the image which is then fused by the fuser. The toner used may be the same for each marking engine of a particular print modality (e.g., process color, custom color, or black) although it is also contemplated that different marking engines of the same print modality may use different toners.

A print media transporting system 80 links the print media source 42 marking engines 14, 16, 30, 32 and finisher 52. The print media transporting system 80 includes a network of flexible paper pathways that feeds to and collects from each of the marking engines. The print media transporting system 80 may comprise drive members, such as pairs of rollers 82, spherical nips, air jets, or the like. The system 80 may further include associated motors for the drive members, belts, guide rods, frames, etc. (not shown), which, in combination with the drive members, serve to convey the print media along selected pathways at selected speeds. In the illustrated embodiment, print media from source 42 is delivered to the marking engines 14, 16, 30, 32 by a pathway 84 which is common to a plurality of the trays. In marking engine 14, the print media is printed by imaging component 60 and fused by fuser 88. Similarly, print media is printed and fused by the respective imaging components and fusers in the other marking engines.

The network 80 of paper pathways allows print media which has been marked by two or more marking engines of the same print modality, such as marking engines 14 and 16, to be assembled in a common stream. For example, print media is merged in pathway 90 and the combined outputs are delivered to the output destination 52. It will be appreciated that the marking engines may be configured for duplex or simplex printing and that a single sheet of paper may be marked by two or more of the marking engines or marked a plurality of times by the same marking engine, for example, by providing internal duplex pathways.

The pathways of the illustrated network 80 may include at least one main downstream highway 100, 102 (two in the illustrated embodiment) and at least one upstream highway 104. The downstream and upstream highways may be generally parallel and travel generally horizontally, although other arrangements are also contemplated. Ends of the highways 100, 102, 104 are connected at upstream and downstream clover leaf intersections 106, 108, respectively. Pathways, such as pathways 110, 112, feed from the main highways to and from the marking engines. The pathways 110, 112, etc. of the network 80 may include inverters, reverters, interposers, bypass pathways, and the like, as known in the art, to direct the print substrate between the highway and a selected marking engine or between two marking engines.

In one mode of operation of the printing system, which may be used for parallel simplex printing, a first portion of the sheets comprising a print job is printed by marking engine 14 and a second, different portion of the print job is printed by marking engine 16 and the printed outputs of the two marking engines combined. In another mode of operation, which may be used for single pass duplex printing, at least a portion of the sheets comprising a print job is marked by one marking engine on one side of the sheets and on the other side of the sheets by another marking engine. Thus, for example, a sheet of print media may have side A printed by marking engine 14, be inverted and have side B printed by marking engine 16.

Figure 3:
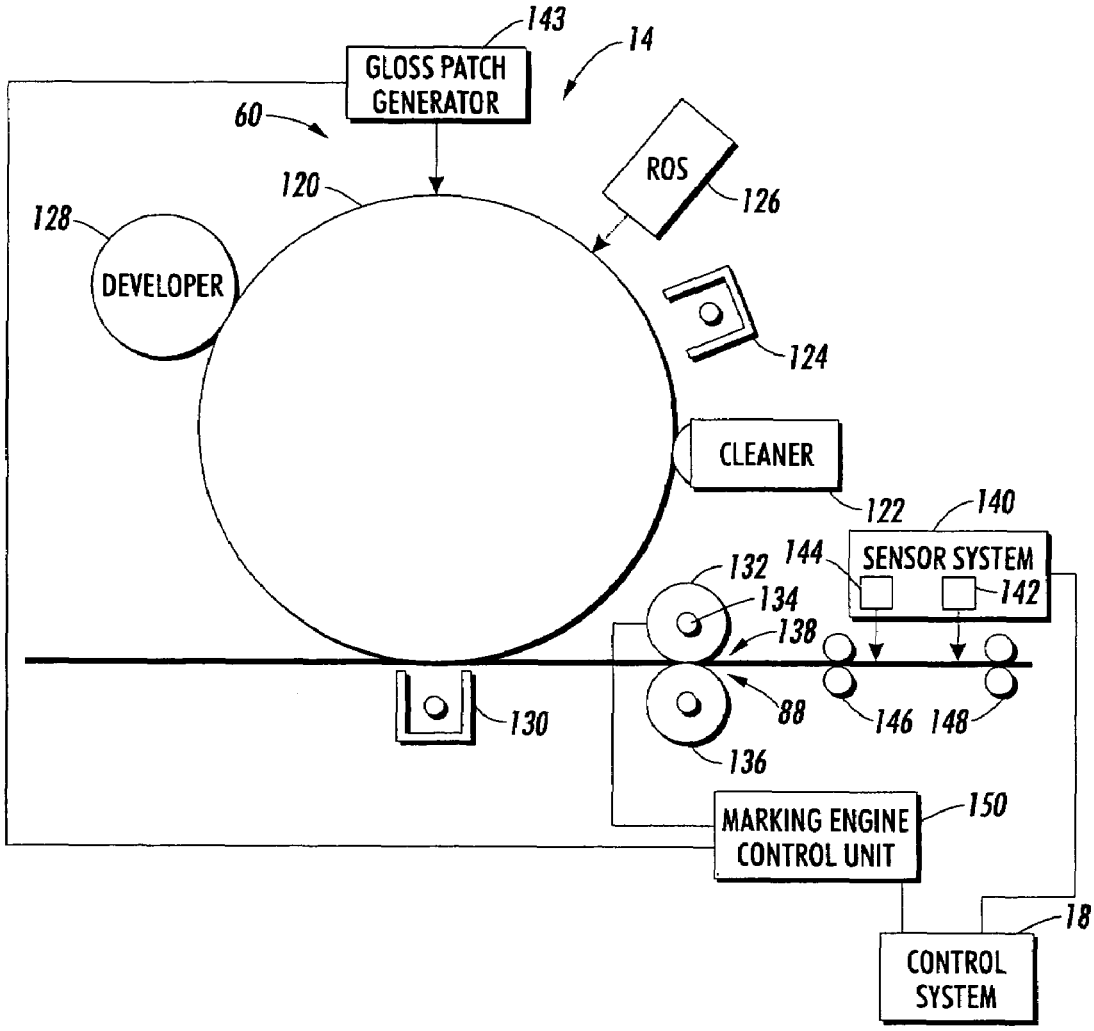
FIG. 3 is an enlarged view of the one of the marking engines of the printing system of FIG. 1.

FIG. 3 shows schematically the components of an exemplary marking engine 14. Marking engines 16, 30, 32 may be similarly configured. As is familiar in the art of electrostatographic printing, the marking engine 14 includes many of the hardware elements employed in the creation of desired images by electrophotographical processes. In the case of an electrographic device, the marking engine typically includes a charge retentive surface, such as a rotating photoreceptor 120 in the form of a belt or drum. The images are created on a surface of the photoreceptor. Disposed at various points around the circumference of photoreceptor 120 are xerographic subsystems which include a cleaning device generally indicated as 122, a charging station 124 for each of the colors to be applied (one in the case of a monochrome marking engine, four in the case of a CMYK marking engine), such as a charging corotron, an exposure station 126, which forms a latent image on the photoreceptor, such as a Raster Output Scanner (ROS), a developer unit 128, associated with each charging station for developing the latent image formed on the surface of the photoreceptor by applying a toner to obtain a toner image. A transferring unit 130, such as a transfer corotron, transfers the toner image thus formed to the surface of a print media substrate. The fuser 88 receives the printed media with the image tacked to it and fuses the image to the substrate. The illustrated fuser includes a rotating fuser roll 132, which is heated by a fuser roll heater 134, such as a resistance heater, and a pressure roll 136, the two rolls defining a nip 138 there between through which the print media passes. One or both of the fuser roll and the pressure roll is driven by a suitable drive system (not shown).

An in-line sensor system 140 detects gloss levels of images. The sensor system includes a sensing element 142 which conducts appearance measurements, e.g., gloss measurements, on a printed sheet as it passes the sensor. While the illustrated system is shown as having a single sensor system 140 which evaluates printed images from all of the marking engines, it will be appreciated that each marking engine may be associated with its own sensor system or sensor element, or that two or more marking engines may be associated with one sensor element, such as engines 14,16. Where two or more sensors are employed, these can be calibrated periodically against an external reference sensor and/or against each other to ensure consistency.

The sensor element 142 may impose constraints upon sheet transport during scanning. For example, the sheet may need to pass the sensor element more slowly than would be the case for normal productivity and may need to be held accurately at the focal depth of the sensor optics. A sensor system of this type is disclosed for example, in U.S. Provisional Application Ser. No. 60/631,656, entitled "MULTI-PURPOSE MEDIA TRANSPORT HAVING INTEGRAL IMAGE QUALITY SENSING CAPABILITY," filed Nov. 30, 2004, the disclosure of which is incorporated herein in its entirety, by reference.

The sensor system 140 may be an inline or offline sensor. For example, the sensor system 140 may be located within the network 80, such as on one of the main highways 100, 102, 104, e.g., highway 104, although other locations are contemplated, such as in exit pathway 90. In one embodiment, illustrated in FIG. 3, the sensor system 140 includes a sensor element 142, such as a gloss or other reflectance sensor. Gloss can be determined in a number of ways, for example, specular gloss is the percentage of the intensity of the incident light (at a specified angle of incidence, and in a specified wavelength range) which is reflected from the surface. The sensor element 142 may alternatively or additionally include means for measuring other optical appearance properties, such as a calorimeter, spectrophotometer and/or other means for generating and processing color information.

The sensor system 140 may sense gloss values of sheets destined to be part of a finished document. In one embodiment, only a portion of the printed sheets are sensed with the sensor. Or, the sensor may sense a test patch or patches on a test sheet to be subsequently discarded. The test patches or images are compared to reference values for calibration of the marking engines. The control system makes any appropriate changes to adjust various xerographic parameters in one or more of the marking engines to adjust the image quality, based on the sensed measurements.

In one embodiment, a gloss patch generator 143 (FIG. 3), which may be associated with the control system 18, periodically sends test patches to the marking engines to be printed and the printed images are routed to the sensor 140 for evaluation. The test patches may be printed with a fiducial mark, which is detected by a fiducial mark sensor 144 in the sensor system. The fiducial mark sensor then actuates the sensor element 142. It is contemplated that each marking engine may record a marking engine identifier on the print media. For example, a printed marker could be embedded in the image to be scanned which would identify which marking engine produced the sensed sheet.

The sensor element 142 may be a full width array sensor which is capable of scanning the full cross-process width of the sheet. Sensor system 140 may also include drive elements 146, 148, illustrated as pairs of rollers, although other drive elements, such as airjets, spherical balls, and the like are also contemplated. During a scanning operation by the sensor element, the inlet feeder rollers 146 decelerate the sheet so that it can be scanned at a predetermined velocity. Outlet feeder rollers 148 accelerate the sheet to the inlet velocity after the sheet has been scanned. In operation, a speed control algorithm controls the velocity at which the sheet passes through sensor system 140 such that sheets not scheduled to be sensed travel at a higher velocity through highway 104 than sheets being scanned, which are decelerated to a lower scan speed and then reaccelerated to the higher velocity after scanning.

The sensor system 140 senses/measures image quality parameters, such as gloss, of printed sheets traveling therethrough and generates a control signal therefrom. In generating the control signal, the sensed parameters may be compared with sensed parameters of printed sheets from another marking engine, such as one of the same print modality, or with sensed parameters generated from a test sheet. The control system 18 is in communication with the sensor system 140 and identifies which marking engine produced the printed sheet sensed and adjusts image quality parameters of the marking engine, e.g., by adjusting machine actuators associated with the marking engines that effect image quality parameters in the marking engines based on the control signal. In the illustrated embodiment, each marking engine includes a control unit 150 which communicates with the control system and adjusts the machine actuators in response to commands from the control system.

For example, if the sensor element 142 detects a gloss level of a test sheet coming from one process color marking engine 14, 16 which is outside a pre-specified tolerance range for the gloss of the process color engines in the printing system 10 (or which falls outside an acceptable range of variation from another process color marking engine in the system), a software controlled adjustment of the fuser temperature may be made. The control system 18 may instruct the marking engine control unit which, in turn, adjusts a machine actuator for the marking engine from which the sheet came to bring the marking engine within specification. The machine actuator may be, for example, an actuator for the fuser roll heater 134. Since gloss generally increases with increasing fuser roll temperature, a low gloss measurement may be addressed by increasing the fuser roll temperature, and vice versa. Other factors which affect gloss include pressure on the fuser rolls and dwell time in the fuser roll nip, which may be alternatively or additionally controlled to achieve a desired gloss level.

A scheduling system 202 (FIG. 1) may schedule selected substrates to be measured by the sensor element 142 and optionally plans the slowing down and speeding up of the print media as it passes the sensor element 142 without substantially affecting the overall productivity of the system. The scheduling system 202 may also schedule the printing of a print job including the marking engines to be used and the route of each sheet of the print job through the system. The scheduling system 202 may be associated with the control system 18, and schedule print jobs based on various constraints, such as optimizing the output of the printing system. Various methods of scheduling print media sheets may be employed. For example, U.S. Pat. No. 5,095,342 to Farrell, et al.; U.S. Pat. No. 5,159,395 to Farrell, et al.; U.S.

Pat. No. 5,557,367 to Yang, et al.; U.S. Pat. No. 6,097,500 to Fromherz; and U.S. Pat. No. 6,618,167 to Shah; U.S. application Ser. Nos. 10/284,560; 10/284,561; and 10/424,322 to Fromherz, all of which are incorporated herein in their entireties by reference, disclose exemplary scheduling systems which can be used to schedule the print sequence herein, with suitable modifications to allow for scheduling of creation of test sheets or documents sheets and their transport to and from the sensor 140.

The scheduling system 202 receives information about the print job or jobs to be performed from a previewer, not shown, which may be associated with the input output interface 12, and proposes an appropriate route for the print media to follow in each of the jobs. The scheduling system confirms with each of the system components, such as marking engines, inverters, etc. that they will be available to perform the desired function, such as printing, inversion, etc., at the designated future time, according to the proposed schedule. Optionally, once the route has been confirmed in this way, any fuser temperature modifications are determined by the control system 18 and the marking engines 14, 16, 30, 32 notified so the fusers 88 will be at the appropriate temperature when the print media arrives.

As an alternative to an in-line sensor, test sheets may alternatively be carried to an off-line sensor for measurement and the results fed to the control system 18.

The in-line or off-line sensor may be, for example, a Gardner gloss meter or other suitable reflectance sensor. Gloss can be measured at a fixed angle, e.g., at 70° or at 85°, at room temperature, in accordance with the procedure set forth in ASTM D523.

In one embodiment, the control system 18 compares the gloss levels of images from each of the marking engines 14, 16, 30, 32 which are desired to be consistent (the consistency set) and makes adjustments to bring those marking engines into consistency. The consistency set may include all marking engines of a particular print modality, such as the process color marking engines 14, 16, or, where there are multiple marking engines of a particular modality, the consistency set may be a selected subset of the marking engines which is to be used in generating a print job. The scheduling system 202 may communicate the subset of marking engines to be used in the print job to the control system 18. In this way, the control system 18 ensures that at least those marking engines of a selected print modality which are to be used in a print job or set of print jobs are consistent.

The marking engine fuser temperature adjustments may be obtained from a look up table which includes measured gloss levels at several different fuser temperature settings. Alternatively, or additionally, an iterative process is used. If the gloss level of one marking engine is too high, for example, the control system 18 instructs the marking engine to adjust the fuser temperature setting downwards. Another test patch is run and further adjustments made, as appropriate, until the measured gloss falls within a desired range.

In another embodiment, the fuser temperatures may be adjusted manually, either by using temperature set points proposed by the control system 18 or in an iterative process. For example, an operator receives gloss values for each of the marking engines from the off-line or in-line sensor and makes adjustments to the set points to achieve consistency. In one embodiment, each of the marking engines is provided with a temperature adjustment actuator for the fuser, such as a knob 210, which is adjusted by the operator. The temperature adjustment actuator allows an operator (or the control system in an automated system) to make a limited adjustment to the temperature which is in a predetermined range of acceptability between a minimum level determined to give an acceptable fix and a maximum level which does not cause damage to the fuser.

In yet another embodiment, the marking engines are programmed or controlled to run through a routine in which the gloss at several different fuser temperatures is measured for each marking engine. The settings for each of the marking engines are then selected, based on the gloss results obtained, to give a consistent gloss.

In aspects of the exemplary embodiment, the control system or the operator (e.g., if the adjustments are being performed manually) designates one of the marking engines in the consistency set as the base marking engine. This is the marking engine which outputs print media with the lowest measured gloss when the fuser is operating at the maximum operating temperature. The other marking engines in the consistency set are then adjusted with the aim of achieving the gloss level of the base marking engine. For example, the fuser roll temperatures are lowered, so that the measured gloss levels of all the marking engines in the consistency set are generating print media outputs which are consistent, i.e., within a predetermined acceptable range of gloss. The adjustment may involve an iterative process in which several test sheets are sent to the sensor and evaluated, followed by further adjustments to the fusers, as necessary, until the outputs are consistent.

The consistency check is performed periodically. In one embodiment, a consistency check is performed at the start of each day. Further consistency checks may be performed throughout the day if desired, for example, if the gloss level of one or more marking engines varies over a period of time to the extent that the marking engines are no longer consistent.

As an alternative to measuring gloss levels on printed sheets, the temperature of the fuser rolls 132 may be measured with a temperature sensor positioned in contact with or closely adjacent the fuser roll. One such sensor is disclosed, for example, in U.S. Pat. No. 6,101,345 to Van Goethem, et al., the disclosure of which is incorporated herein in its entirety. The control system uses an algorithm for each of the marking engines which associates the fuser roll temperatures with corresponding gloss levels. Based on the algorithm, the control system determines which fuser/marking engine is operating at the lowest gloss. This marking engine is then designated as the base marking engine and the temperatures of the other marking engines adjusted to achieve a consistent gloss.

It will be appreciated that a fuser roll 132 has a finite time for reaching temperature, which may depend on the type of fuser and the extent of the temperature adjustment. For example, a fuser may take several seconds or even minutes to drop a few degrees centigrade. Thus, major fuser roll adjustments are generally performed prior to printing of a print job, although further adjustments may be made during a print job.

In the event that the marking engines scheduled for printing parts of a job do not have an overlapping operating range for providing consistent gloss, the control system may signal to the user that one of the marking engines is out of range. For example, it may be time to switch out the fuser as it has reached the end of its useful life. The scheduling system may schedule printing such that only those marking engines which can provide consistent gloss are used for the particular job. This may entail, for example, printing a job on only one marking engine whereas normally it would be scheduled for printing on two.

It will be appreciated that for some applications, high gloss may not be desirable, in which case a gloss level which is lower than the maximum achievable by the base marking engine may be selected.

Without intending to limit the scope of the application, the following example demonstrates the effects of fuser temperature on crease and gloss.

EXAMPLE

Figure 4:
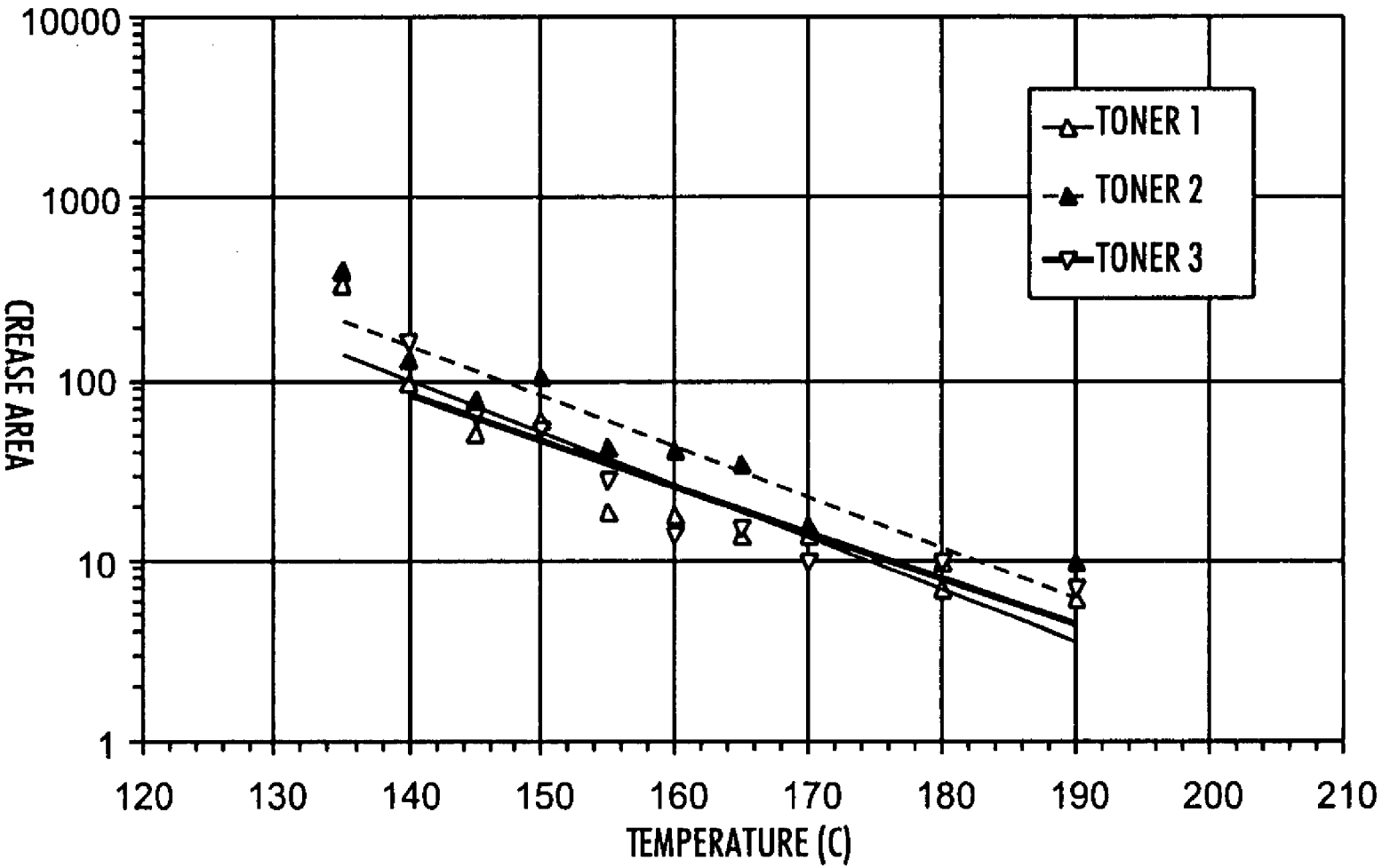
FIG. 4 is a plot of crease area (fix) versus temperature.
Figure 5:
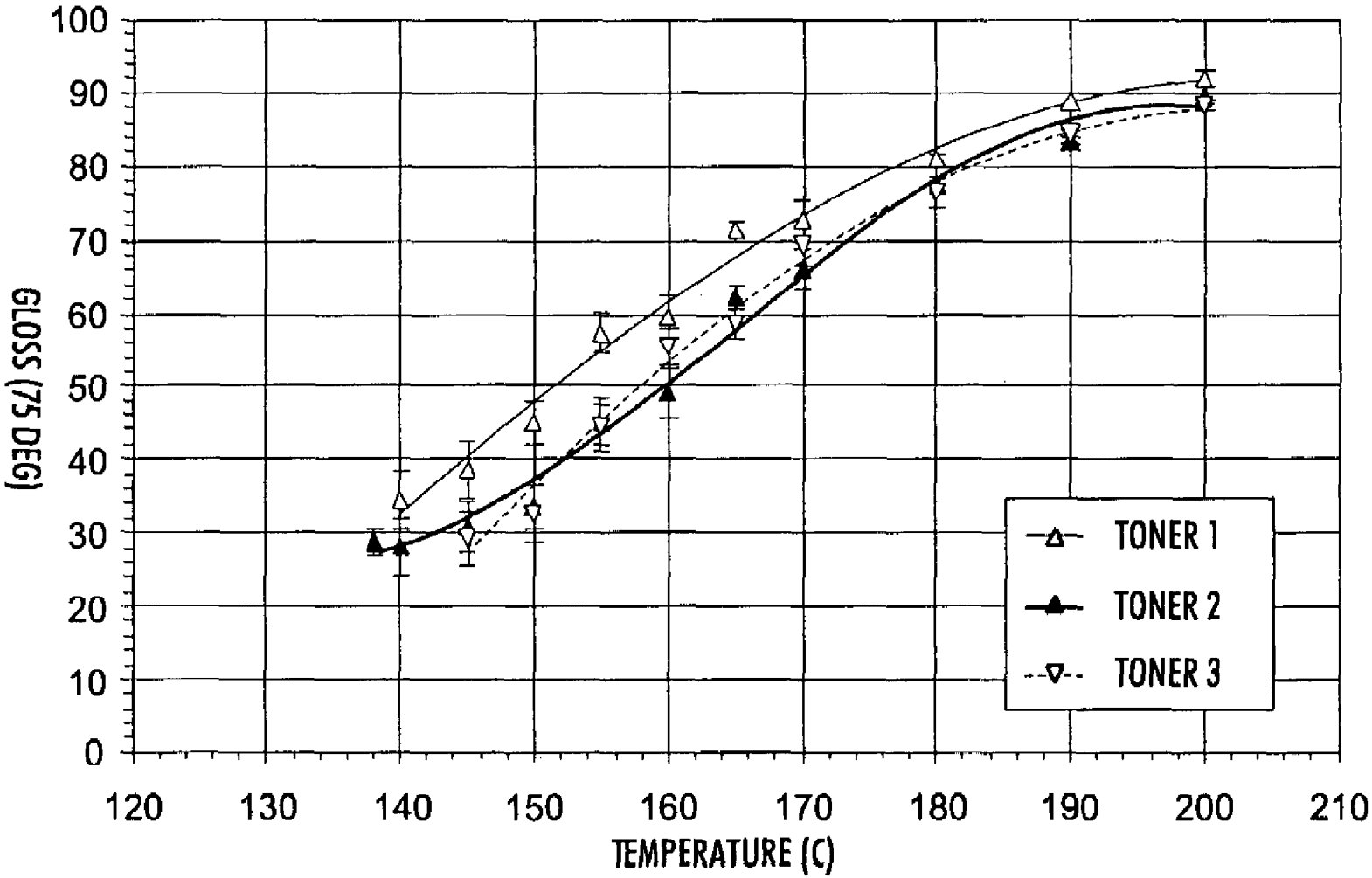
FIG. 5 is a plot of gloss versus temperature.

FIGS. 4 and 5 demonstrate that the gloss on a print and the level of fix are both functions of fusing temperature. Three different toners were used in studying the effects of temperature. These toners have been labeled toner 1, toner 2, and toner 3.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A printing system comprising:

a plurality of marking engines which are operatively coupled to generate images to print media;

an output destination which is configured for receiving imaged print media from the plurality of marking engines;

a print media transport system which conveys print media between the marking engines and the output destination; and a control system which determines whether the marking engines are printing images of acceptable gloss and optionally adjusts at least one of the plurality of marking engines to minimize a variation in gloss of said images, the control system designating a marking engine as a base marking engine, the base marking engine having a lowest value of gloss at its maximum running temperature for images applied by the plurality of marking engines, and the control system adjusting at least one other of the plurality of marking engines to reduce a variation in gloss between images applied by the base marking engine and the other marking engine.

2. The printing system of claim 1, further comprising a sensor system which measures the gloss of images from the plurality of marking engines and generates a control signal therefrom.

3. The printing system of claim 2, wherein the control signal includes data associating the printed media measured with one of the plurality of marking engines which generated the printed media.

4. The printing system of claim 2, wherein the transport system includes a common path which is accessible from the plurality of marking engines and the sensor is associated with the common path.

5. The printing system of claim 2, wherein the output destination receives printed media from the sensor system.

6. The printing system of claim 1, wherein the output destination is a post printing destination where the printed media of a document are together, ordered in a sequence for assembly into a finished document.

7. The printing system of claim 1, wherein the output destination comprises at least one of a sorter, mailbox, inserter, interposer, folder, stapler, collater, stitcher, binder, over-printer, envelope stuffer, postage machine, and output tray.

8. The printing system of claim 1, wherein the plurality of marking engines comprises at least first and second marking engines of the same print modality.

9. The printing system of claim 8, wherein the print modality is selected from process color, custom color, and black.

10. The printing system of claim 1, wherein the adjustment of the at least one other of the plurality of marking engines to reduce a variation in gloss includes lowering an operating temperature of a fuser associated with the at least one other of the plurality of marking engines.

11. A printing system comprising:

a plurality of marking engines which are operatively coupled to generate images to print media;

an output destination which is configured for receiving imaged print media from the plurality of marking engines;

a print media transport system which conveys print media between the marking engines and the output destination, the transport system including a common path which is accessible from the plurality of marking engines;

a sensor system associated with the common path, which measures the gloss of images from the plurality of marking engines and generates a control signal therefrom, the common path including a drive element for moving print media at a first predefined velocity when the print media is to be measured and at a second predefined velocity when the print media is not to measured; and a control system which determines whether the marking engines are printing images of acceptable gloss and optionally adjusts at least one of the plurality of marking engines to minimize a variation in gloss of said images.

12. A printing system comprising:

a plurality of marking engines which are operatively coupled to generate images to print media;

an output destination which is configured for receiving imaged print media from the plurality of marking engines;

a print media transport system which conveys print media between the marking engines and the output destination;

a control system which determines whether the marking engines are printing images of acceptable gloss and optionally adjusts at least one of the plurality of marking engines to minimize a variation in gloss of said images; and a recorder for recording indicia on the printed media, the indicia having origination identifying data.

13. The printing system of claim 12, further comprising a sensor element which reads indicia and measures the image quality parameters.

14. A printing system comprising:

a plurality of marking engines which are operatively coupled to generate images to print media;

an output destination which is configured for receiving imaged print media from the plurality of marking engines;

a print media transport system which conveys print media between the marking engines and the output destination;

a control system which determines whether the marking engines are printing images of acceptable gloss and optionally adjusts at least one of the plurality of marking engines to minimize a variation in gloss of said images;

a sensor system which measures the gloss of images from the plurality of marking engines and generates a control signal therefrom; and a sheet scheduler for scheduling selected substrates to be measured by the sensor system.

15. The printing system of claim 14, wherein the control system designates a marking engine as a base marking engine, the base marking engine having a lowest value of gloss at its maximum running temperature for images applied by the plurality of marking engines, and adjusts at least one other of the plurality of marking engines to reduce a variation in gloss between images applied by the base marking engine and the other marking engine.

16. A method of printing comprising:

determining whether a plurality of marking engines which are operatively coupled are printing images of consistent gloss and, where the marking engines are determined not to be consistent, adjusting at least one of the plurality of marking engines to reduce a variation in gloss between images applied by the marking engines, the determining of the gloss level including determining a maximum gloss level which can be achieved by all of the plurality of marking engines;

printing images on print media with the plurality of marking engines; and conveying the printed images in a common stream to an output destination.

17. The method of printing of claim 16, further comprising:

determining a level of gloss which can be achieved by all of the plurality of marking engines; and adjusting at least one of the plurality of marking engines to lower the gloss of images applied by the at least one marking engine.

18. A method of printing comprising:

determining whether a plurality of marking engines which are operatively coupled are printing images of consistent gloss and, where the marking engines are determined not to be consistent, determining which of a plurality of marking engines is outputting printed media with the lowest gloss;

adjusting at least one other of the plurality of marking engines to reduce a variation in gloss between the one other and the marking engine which outputs with the lowest gloss;

printing images on print media with the plurality of marking engines; and conveying the printed images in a common stream to an output destination.

19. The method of printing of claim 18, wherein the determining of the gloss level further includes determining a maximum gloss level which can be achieved by all of the plurality of marking engines.

* * * * *